US008068748B2

(12) United States Patent
Pearce et al.

(10) Patent No.: US 8,068,748 B2
(45) Date of Patent: Nov. 29, 2011

(54) METHODS AND SYSTEMS FOR SENSING AN AMOUNT OF MATERIAL IN A TONER CARTRIDGE

(75) Inventors: David J. Pearce, Bendish (GB); Martin R. Walsh, St. Albans (GB)

(73) Assignee: Xerox Corporation, Norwalk, CT (US)

( * ) Notice: Subject to any disclaimer, the term of this patent is extended or adjusted under 35 U.S.C. 154(b) by 896 days.

(21) Appl. No.: 12/103,753

(22) Filed: Apr. 16, 2008

(65) Prior Publication Data

US 2009/0263146 A1 Oct. 22, 2009

(51) Int. Cl.
*G03G 15/08* (2006.01)

(52) U.S. Cl. ..... 399/27

(58) Field of Classification Search ..... 399/27, 399/258, 262

See application file for complete search history.

(56) References Cited

U.S. PATENT DOCUMENTS

| | | | | |
|---|---|---|---|---|
| 4,603,714 | A | 8/1986 | Marotta | |
| 4,682,874 | A | 7/1987 | Fantuzzo | |
| 4,972,230 | A | 11/1990 | Wayman | |
| 4,989,754 | A | 2/1991 | Grasso et al. | |
| 5,081,498 | A | 1/1992 | Bares | |
| 5,289,955 | A | 3/1994 | Sulenski | |
| 5,465,619 | A | 11/1995 | Sotack et al. | |
| 5,495,323 | A | 2/1996 | Meetze, Jr. | |
| 5,576,816 | A | 11/1996 | Staudt et al. | |
| 5,613,177 | A | 3/1997 | Meetze, Jr. et al. | |
| 5,774,773 | A * | 6/1998 | Otsuka et al. | 399/262 |
| 6,249,654 | B1 | 6/2001 | Kurz et al. | |
| 6,266,506 | B1 | 7/2001 | Kurz et al. | |
| 6,269,234 | B1 | 7/2001 | Kurz et al. | |
| 6,289,182 | B1 * | 9/2001 | Umezawa et al. | 399/12 |
| 6,332,065 | B1 | 12/2001 | Howard | |
| 6,363,235 | B1 | 3/2002 | Chiesa et al. | |
| 6,421,518 | B1 | 7/2002 | Floyd et al. | |
| 6,510,292 | B1 | 1/2003 | Owen et al. | |
| 7,088,930 | B2 * | 8/2006 | Mimura | 399/27 |

* cited by examiner

*Primary Examiner* — David Gray
*Assistant Examiner* — Billy J Lactaoen
(74) *Attorney, Agent, or Firm* — Fay Sharpe LLP

(57) ABSTRACT

A method and system to sense an amount of material such as toner in a container held in a horizontal position within a machine, such as a printing machine. A level sensor senses an amount of material within a dispensing unit which causes the level sensor to issue a signal. The dispensing unit is external to the container. The container holding the material is rotated, and a rotation direction reversed to a direction normally used to dispense the material. The reverse rotation direction moves the material to a closed end of the container. The container is then moved in a forward direction following the rotation of the container in the reverse direction. The forward rotation moves the material to the open end of the container, and the material further moves into the dispensing unit. A signal is generated when a sufficient amount of material has been moved into the dispensing unit. A time period is determined which represents the time it took to move the material from the closed end of the material, until the signal indicating a sufficient amount of material exists in the dispensing unit. The amount of material in the container is estimated by use of the determined time period.

18 Claims, 5 Drawing Sheets

METHODS AND SYSTEMS FOR SENSING AN AMOUNT OF MATERIAL IN A TONER CARTRIDGE

BACKGROUND

The present application relates to electrophotographic printing. More specifically, the application relates to a system and method for calculating an amount of toner in a toner container located within a electrophotographic printing machine.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable toner which is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced.

The electrophotographic process is useful for light lens copying from an original as well as printing electronically generated or stored originals such as with a raster output scanner (ROS), where a charged surface may be image wise discharged in a variety of ways.

Existing electrophotographic printing machines are commonly supplied with replaceable containers which hold the toner. Typically, such a container is positioned horizontally within the printing machine, and therefore gravity does not ensure movement of the toner towards the latent image. Thus a mechanism, such as an auger, is needed to move the toner. One particular container design is a cylindrical container having an opening near one end and internal spiral ribs, which when rotated urges the toner to the opening. Such containers are also called bottles or cartridges among other names.

BRIEF DESCRIPTION

A method and system to sense an amount of material such as toner in a container held in a horizontal position within a machine, such as a printing machine. A level sensor senses an amount of material within a dispensing unit which causes the level sensor to issue a signal. The dispensing unit is external to the container. The container holding the material is rotated, and a rotation direction reversed to a direction normally used to dispense the material. The reverse rotation direction moves the material to a closed end of the container. The container is then moved in a forward direction following the rotation of the container in the reverse direction. The forward rotation moves the material to the open end of the container, and the material further moves into the dispensing unit. A signal is generated when a sufficient amount of material has been moved into the dispensing unit. A time period is determined which represents the time it took to move the material from the closed end of the material, until the signal indicating a sufficient amount of material exists in the dispensing unit. The amount of material in the container is estimated by use of the determined time period.

DETAILED DESCRIPTION

Figure 1:
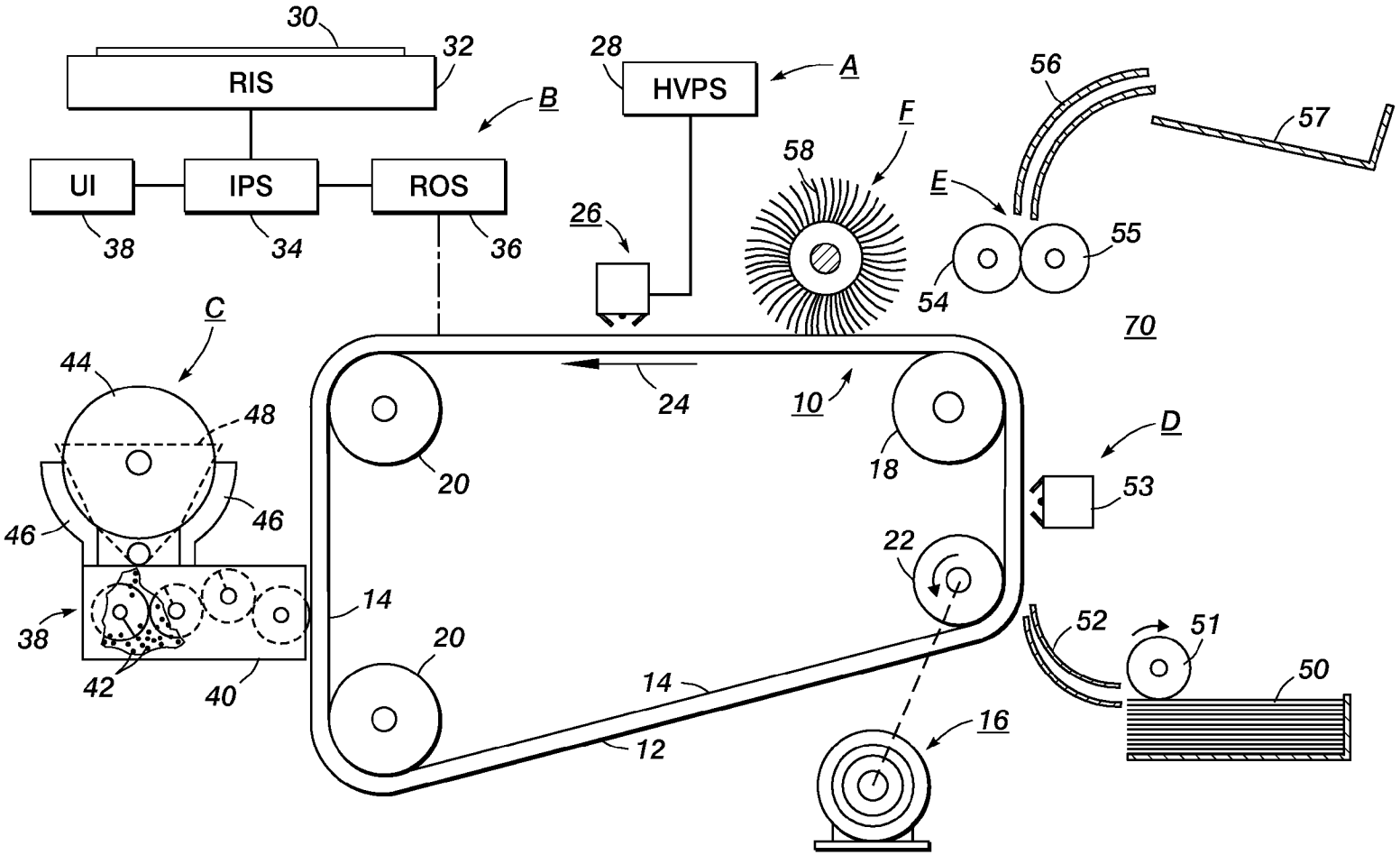
FIG. 1 is a schematic elevation view of an illustrative electrophotographic printing machine in which the concepts of the present application may be incorporated.

FIG. 1 depicts an electrophotographic printing machine to which concepts of the present application are incorporated. The printing machine includes a photoreceptor 10 in the form of a belt having a photoconductive surface layer 12 on a grounded electroconductive substrate 14. The belt is driven by motor 16 along a path defined by rollers 18, 20 and 22, the direction of movement being counter-clockwise as viewed and as shown by arrow 24. Initially a portion of belt 10 passes through a charge station A at which a corona generator 26 charges surface 12 to a relatively high, substantially uniform, potential. A high voltage power supply 28 is coupled to generator 26.

Next, the charged portion of photoconductive surface 12 is advanced through exposure station B. At exposure station B, an original document 30 is positioned on a raster input scanner (RIS) 32. The RIS captures the entire original document and converts it to a series of raster scan lines and (for color printing) measures a set of primary color densities. This information is transmitted to an image processing system (IPS) 34, which is the control electronics used to prepare and manage the image data flow to raster output scanner (ROS) 36. A user interface (UI) 38, is in communication with the IPS. The UI enables the operator to control the various operator adjustable functions. The output signal from the UI is transmitted to IPS 34. The signal corresponding to the desired image is transmitted from IPS 34 to ROS 36, which creates the output copy image. ROS 36 lays out the image in a series of horizontal scan lines with each line having a specified number of pixels per inch.

After the electrostatic latent image has been recorded on photoconductive surface 12, belt 10 advances the latent image to development station C. At development station C, a development system 38, develops the latent image recorded on the photoconductive surface. The chamber in toner housing 40 stores a supply of toner 42 in a toner container 44 held in place by supports 46. Also shown is a sump housing 48. The toner may be a two component toner of at least magnetic carrier granules having toner particles adhering triboelectrically thereto. It should be appreciated that the toner may likewise comprise a one component toner consisting primarily of toner particles.

After the electrostatic latent image has been developed, belt 10 advances the developed image to transfer station D, at which a copy sheet 50 is advanced by roll 51 and guides 52 into contact with the developed image on belt 10. A corona generator 53 is used to spray ions onto the back of the sheet so as to attract the toner image from belt 10 the sheet. As the belt turns around roller 18, the sheet is stripped, with the toner image thereon.

After transfer, the sheet is advanced by a conveyor (not shown) to fusing station E. Fusing station E includes a heated fuser roller 54 and a back-up roller 55. The sheet passes between fuser roller 54 and back-up roller 55 with the toner powder image contacting fuser roller 54. In this way, the toner powder image is permanently affixed to the sheet. After fusing, the sheet advances through chute 56 to catch tray 57 for subsequent removal from the printing machine by the operator.

After the sheet is separated from photoconductive surface 12 of belt 10, the residual toner particles adhering to photoconductive surface 12 are removed at cleaning station F by a rotatably mounted fibrous brush 58 in contact with photoconductive surface 12. Subsequent to cleaning, a discharge lamp (not shown) floods photoconductive surface 12 with light to dissipate any residual electrostatic charge.

It is believed that the foregoing description is sufficient for purposes of the present application to illustrate the general operation of an electro-photographic printing machine which is capable of incorporating the concepts of the present application.

Figure 2:
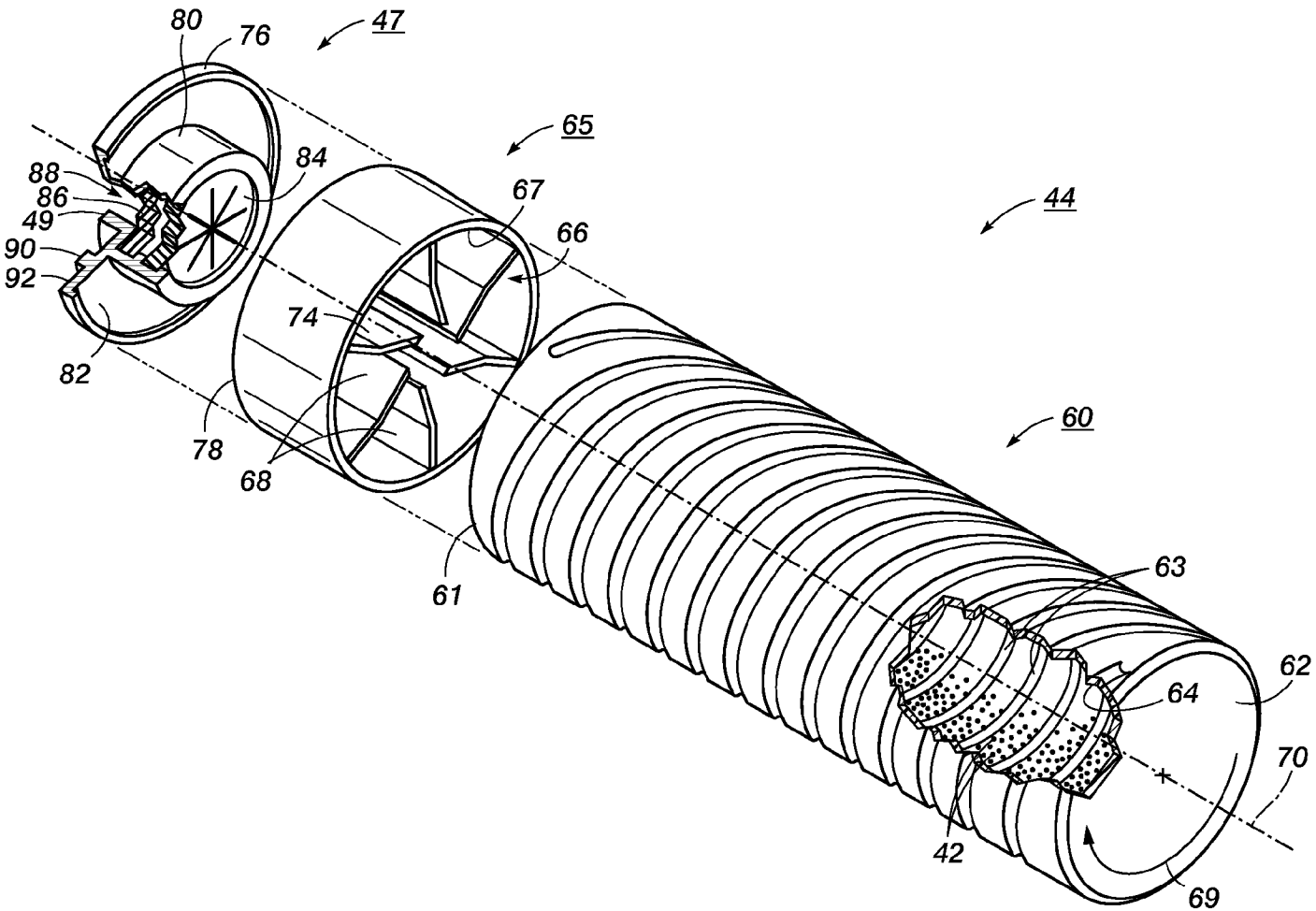
FIG. 2 is an exploded perspective view of a toner cartridge.

Turning to FIG. 2, illustrated is a more detailed view of container 44, used to store the supply of toner 42. Container 44 has a generally cylindrical shape and an opening 47 located on a first end 49. In this embodiment container 44 includes a first generally cylindrically shaped portion 60 having an open end 61 proximate the opening 47 and closed end 62 opposite open end 61. To urge toner 42 from first generally cylindrical shaped portion 60 container 44 includes spiral rib 63 located on an interior periphery 64 of cylindrically shaped portion 60. The spiral rib 63 may have either a right hand or a left hand orientation depending on the corresponding rotation of container 44.

Container 44 also includes a ring shaped portion 65 which extends from open end 61. The ring shaped portion 65 includes radial protrusions 66 which extend inwardly from interior periphery 67.

The radial protrusions 66 have a carrying face 68 which curves in the direction of rotation 69 of container 44 as the radial protrusions 66 extend toward centerline 70 of container 44. The radial protrusions 66 thereby form pockets 74 along carrying face 68. Pockets 74 become filled with toner 42 from open end 61 and carry toner 42 along inner periphery 67.

Container 44 further includes a plate shaped end portion 76 which extends from a second face 78 of ring shaped portion 65. Plate shaped portion 76 includes first end 49 as well as opening 47. Plate shaped portion 76 also includes an interior hub 80 which extends inwardly from a disc area 82 of end portion 76. A puncturable seal 84 is located within interior hub 80. Seal 84 serves to contain toner 42 during installation and removal of container 44. To provide sealing in addition to puncturable seal 84 when container 42 is installed into the machine, a secondary seal 86 is located in interior hub 80 spaced outwardly from and parallel to puncturable seal 84. The secondary seal 86 contains a central opening 88 which slidably fits over an auger tube 114 (see FIG. 5) and seals upon installation into development system 38 (see FIG. 5). The plate shaped end portion 76 further includes pins 90 extending outwardly from outer face 92 of the disc area 82. The pins 90 are used to interconnect with development system 38.

Figure 3:
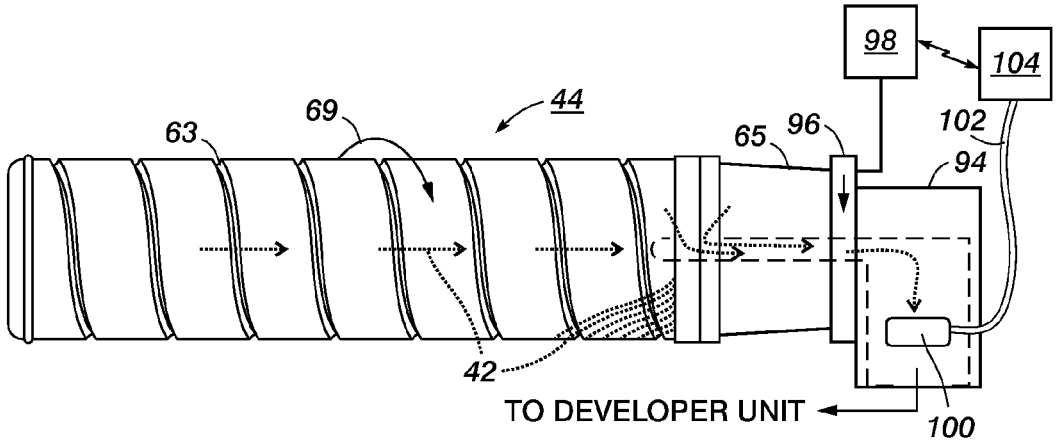
FIG. 3 depicts dispensing of toner from the container.

Turning to FIG. 3, provided is a simplified illustration of the operations used to dispense toner from container 44. The system of FIG. 3 includes toner level sensing capabilities to determine if sufficient toner is available. During normal operation, container 44 rotates in direction 69, causing toner 42 to migrate to the opening of the container and out into toner dispensing unit 94, and then to toner housing 40 of FIG. 1. As depicted by this figure, ring-shaped portion 65 is motivated by drive mechanism/gearing arrangement 96, which is connected to motor 98. Particularly, gearing arrangement 96 rotates container 80 in direction 69 by actuation of motor 98. This movement causes interior ribs 63 to push toner 42 to the opening of container 44 where it is then moved into dispensing unit 94, such as by an auger system.

Included in this figure is a toner level sensor 100 connected, via a signal line 102, to an input of controller 104. Level sensor 100 senses the amount of toner in dispensing unit 94, and depending on the amount of toner in dispensing unit 94 it issues a signal to controller 104 informing controller 104 as to the status of toner in dispensing unit 94. An output of controller 104 is in operative communication with motor 98, and controls operation of motor 98. For example, when sensor 100 indicates a depleted toner level, in normal operation motor 98 is energized, causing the container to rotate in direction 69, whereby internal rib 63 migrates the toner to the open end of the container and into the dispensing unit 94. Once sensor 100 senses sufficient toner and supplies this signal to controller 104, the controller signals motor 98 to stop, thereby stopping rotation of container 44. By this design, toner is delivered to the system to ensure a continuous supply during imaging operations. However, while this system is effective for supplying toner when there is sufficient toner in the container, it does not address the issue of determining when the container is low or nearly empty and will need to be replaced with another container which is full of toner.

Figure 4A:
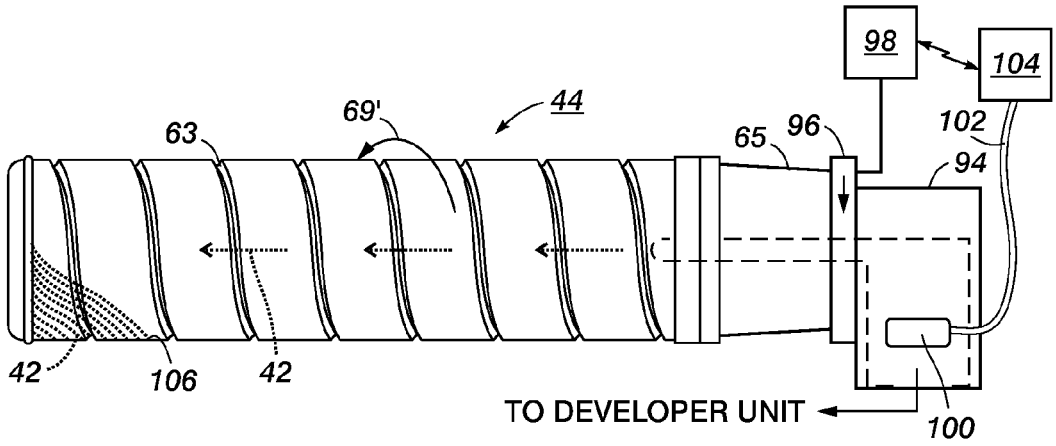
FIGS. 4A-4C illustrate the operation of the toner level sensing system of the present application.
Figure 4B:
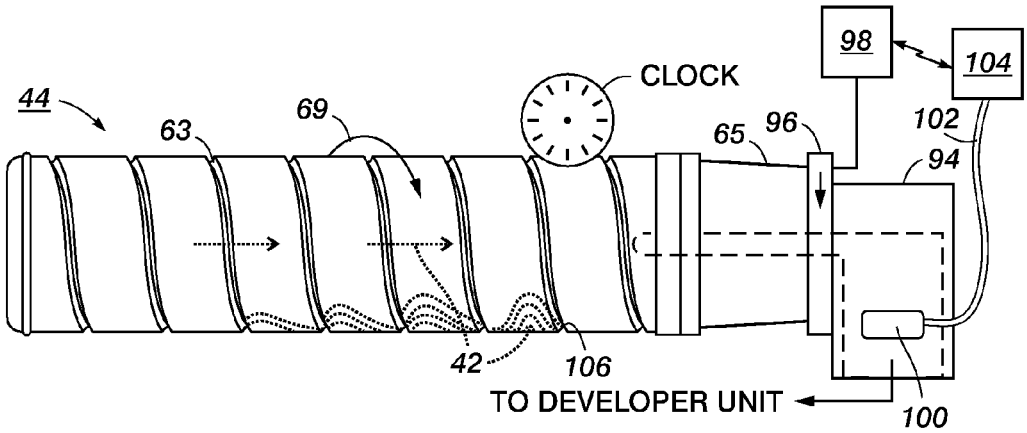
Figure 4C:
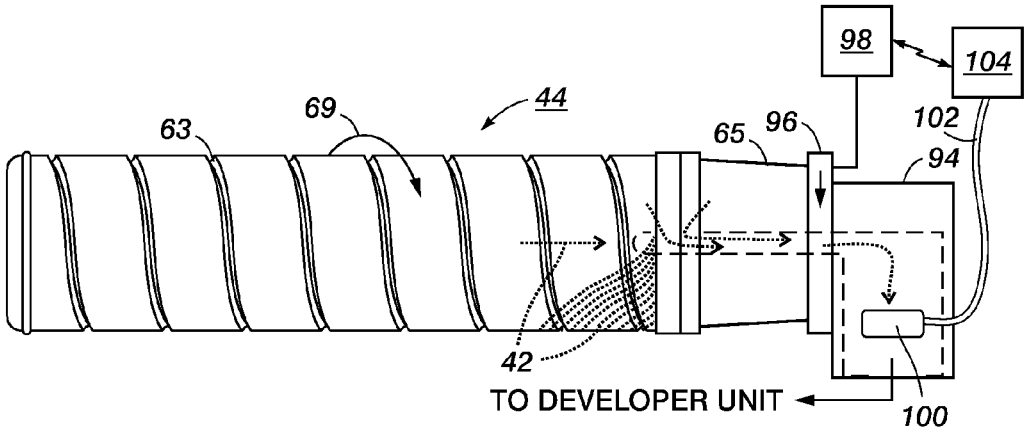

Turning now to FIGS. 4A-4C, illustrated are toner level sensing concepts of the present application to address the above issue. More particularly, FIG. 4A depicts a situation where toner 42 in dispensing unit 94 is below level sensor 100, a signal informing the controller of this situation is therefore provided to controller 104 via signal line 102. At this point during normal operation, controller 104 would issue a signal instructing motor 98 to rotate container 44 in direction 69 so to migrate toner to the opening of the container in order to refill toner dispensing unit 94. However, in this present embodiment, gearing system 96 and motor 98 are arranged in such a way that container 44 can be rotated in a reverse direction 69'. Then controller 104 issues a signal to motor 98 to operate in the reverse direction. The instructions causing the reverse rotation may be software instructions within controller 104.

As illustrated in FIG. 4A, reversing rotation of container 44 causes internal rib 63 to migrate toner 42 away from the opening, to the back closed end of container 44. Once the reverse rotation has moved the toner to the back of the container, this reverse rotation is stopped. Then as illustrated in FIG. 4B normal rotation is resumed. At the start of normal rotation (the 69 direction), controller 104 will also start a software timer/clock (Clock), which continues until level sensor 100 sends a signal to controller 104 that it has been replenished, such as shown, for example, in FIG. 4C. The length of time the container is rotated in the reverse direction can be a predetermined set amount of time, where the set time is determined by experimentation. However, alternatives such as use of a sensor associated with the container or other parts of the printing machine could also be used.

When the toner reaches the open end of the container, the toner is picked up by an auger system for dispensing the toner into the dispenser unit 94, as in the normal operation. The time period it takes the innermost toner (e.g., 106 of FIGS. 4A, 4B) to traverse the length of the container and replenish the dispensing unit to alter the state of the level sensor will vary according to the position of the toner. This time will relate directly to the quantity of toner in the cartridge. In other words, the fuller the cartridge, the closer the leading edge of the toner (pushed back to the closed back end) will be to the dispensing auger, and thus the less distance to travel along the continuous pitch auger (see 112 FIG. 5).

The signal generated by level sensor 100 may be considered a trigger signal which initiates the level sensing operation.

The triggering of the level sensor 100 may occur due to operation of an algorithm/software program stored within a memory area of controller 104. Where, when the program is run within a computation area (e.g., CPU) of the controller, the controller a lows the toner within the dispensing unit to drop below the trigger threshold. For example, the program may simply stop motor 98 from continuing the normal rotation of the container when the toner level sensor has signaled for additional toner, and rather initiates the process described in connection with FIGS. 4A-4C.

The amount of time from the start of the forward rotation until the toner sensor is again replenished is used to determine the amount of toner remaining in container 44. In one embodiment, the elapsed time is recorded in the controller and is used in a transfer function derived from normal engineering calculations to determine the amount of remaining toner. Parameters which may be considered in the development of the transfer function include the size of the container, speed of rotation, density of the toner, among others.

An alternative procedure to determine the amount of toner within a container is to obtain empirical data through repetitive testing. Where the results of the tests are correlated the amount of toner within the container. Particularly, a table can be generated by redundant testing wherein, for example, the container is filled with a known amount of toner. Then the system is operated in accordance with the concepts of FIGS. 4A-4C to determine the migration time of the toner. Next, known amounts of toner are removed from the container and additional tests are undertaken to determine the toner migration time for these toner amounts. The results are collected into a table which associates toner amounts with time values. The table may be electronically stored within the controller, or may be recorded at some separate location.

Results of both above embodiments alone or in combination can then be used by the printing device to issue low toner alerts to a user. Such alerts may be generated via existing audio or visual components which are part of the printing machine. In some embodiments controller 104 includes an electronic display which issues a low toner alert which would be visible to a user and/or a speaker system which issues an audible alert.

In one embodiment, the steps shown in FIGS. 4A-4C are undertaken by controller 104 at known idle times of the printing machine, for example, immediately prior to going to a power-save mode. Alternatively, the tests could be undertaken during a moderately low area coverage print run, if required, as buffer capacity of toner exists in the developing unit which would allow sufficient time to run the procedure without a productivity impact. Replenishing the toner prior to this procedure could be a method of forcing the toner level in the dispensing unit to drop below the sensing threshold.

Figure 5:
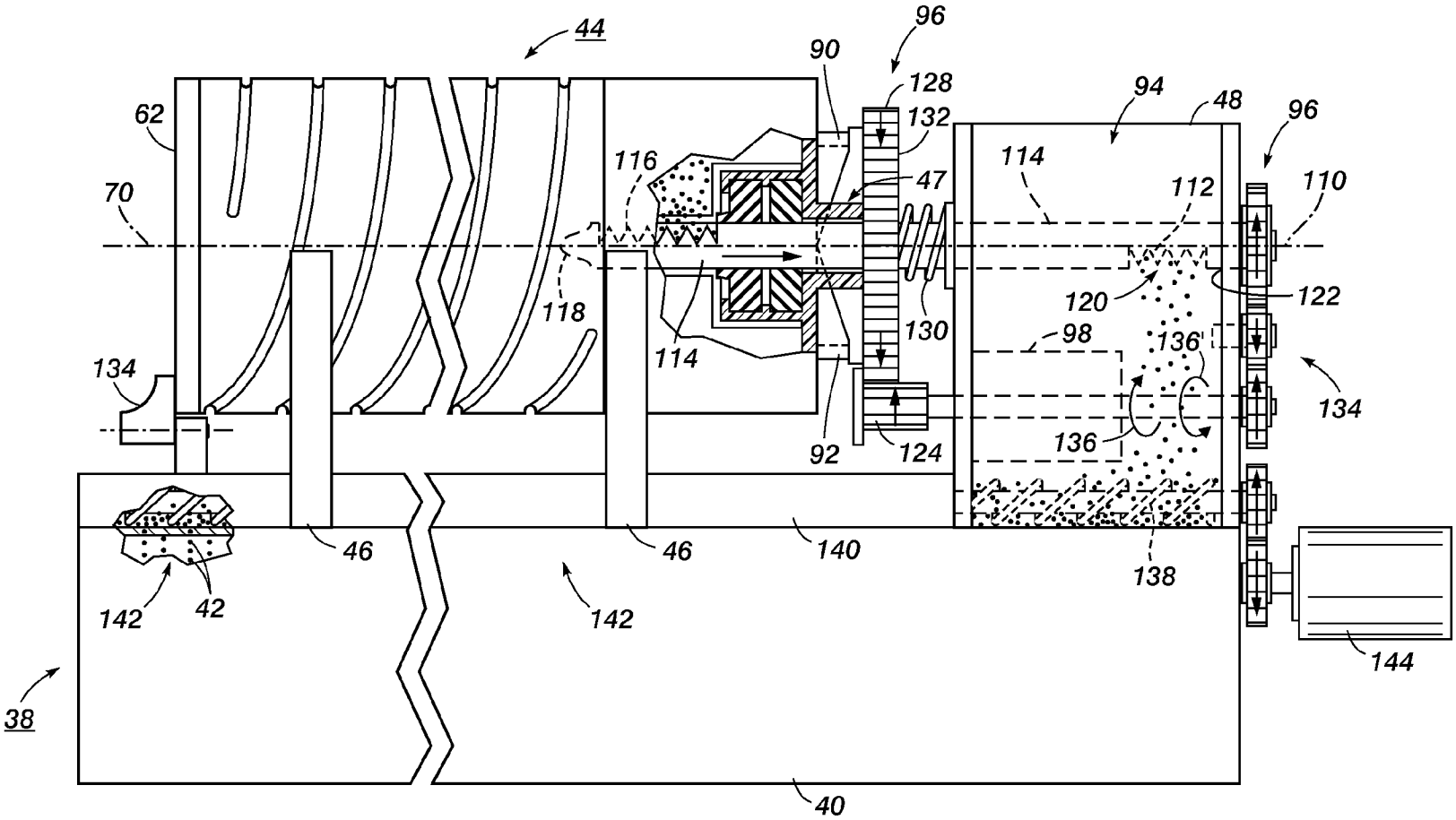
FIG. 5 is a plan view showing a development apparatus which may be used in the printing machine of FIG. 1, including the toner level sensing system of FIGS. 4A-4C.

In one embodiment, the motor drive 98 and gearing/transmission system 96 may use a one-way clutch in the gear train connecting the toner container and the pick-up auger drive (see FIG. 5) to prevent the pick-up auger drive from reversing while the toner cartridge is reversing Referring now to FIG. 5, shown is a more detailed embodiment of development system 38 in which container 44 is installed in a horizontal position.

Development system 38 includes toner housing 40 from which the bottle supports 46 extend. A sump housing 48 extends upwardly from one end of the toner housing 40. A toner dispensing unit (or feed mechanism) 94 extends through sump housing 48 and outwardly therefrom in the direction of centerline 110. The feed mechanism 94 extends through opening 47 of container 44, centerline 110 being co-linear with centerline 70. Feed mechanism 94 is in the form of auger 112 located within tube 114. The tube 114 preferably has an inlet opening 116 in the upper portion of the tube 114 near a first end 118 of tube 114. The tube 114 also has an outlet opening 120 in the bottom portion of tube 114 near second end 122 of tube 114. The development system 38 further includes container drive motor 98 which may be located anywhere within development system 38. The container drive motor 98 serves to rotate container 44 as well as auger 112. It should be appreciated, however, that a separate motor for auger 112 and a separate motor for the marking particle container 44 may be used. Any suitable gear train of gearing arrangement 96 which allows for reverse rotation of container 44, while inhibiting reverse rotation of the auger 112 may be used. For example, motor 98 may have a pinion gear 124 extending inwardly therefrom. A sun gear 126 slidably rotates about tube 114 and meshes with pinion gear 124.

To urge sun gear 126 against container 44 and assure the mating of pins 90 with stops 128, preferably, the development system 38 further includes a spring 130 slidably fitted about tube 114 between the sump housing 48 and second face 132 of sun gear 126. To interconnect container 44 to feed mechanism 94, stops 128 are located on face 132 of sun gear 126 and are aligned adjacent pins 90 of container 44 to cooperate therewith.

To assure container 44 is adequately axially positioned relative to feed mechanism 94, a stop 134 located preferably on toner housing 40 secures container 44 by restraining closed end 62 of container 44. A series of gears 134 preferably interconnect drive motor 98 to the auger 112. The gears 134 are so configured that when motor 98 rotates in the direction of arrow 136, auger 112 will be rotated in a direction to urge the toner 42 from the inlet opening 116 to the outlet opening 120. When motor 98 rotates in the direction of arrow 136', causing reverse rotation of container 44 (i.e., the operation shown in FIG. 4A) auger 112 is prevented from a reverse drive.

The development system 38 further preferably includes a toner auger 138 extending from bottom of the sump housing 48. The auger 138 extends outwardly along the length of toner housing 40. The auger 138 is located within conduit 140. The conduit 140 includes one or more dump holes 142 which permit toner 42 to enter the toner housing 40. Auger 130 can be driven by a toner auger motor 144 to independently control the flow of toner 42 from sump housing 48 to the toner housing 40.

Particles of toner 42 fall into inlet opening 116 of the tube 114 and are thereby carried away by the auger 112.

Particles received at inlet opening 116 translate along auger 112 in the direction of arrow 146 toward outlet opening 120. The toner particles exit the tube 114 at outlet opening 120 and fall to the bottom 140 of the sump housing 48. Auger 138 then carries the marking particles along conduit 140 and through dump holes 142 to the toner housing 40 where they are used in the developing process.

While the foregoing has been described in conjunction with various embodiments, it is evident that many alternatives, modifications, and variations will be apparent to those skilled in the art. For example, while the foregoing discussion has focused on toner material other materials may also take advantage of the described concepts. Accordingly, it is intended to embrace all such alternatives, modifications, and variations as fall within the spirit and broad scope of the appended claims.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for sensing an amount of a material in a container held in a horizontal position within a machine the method comprising:

sensing by a level sensor an amount of the material within a dispensing unit which causes the level sensor to issue a signal, the dispensing unit being external to the container;

rotating the container holding the material in a rotation direction reverse to a direction to dispense the material, wherein the reverse rotation direction moves the material to a closed end of the container;

rotating the container in a forward rotation direction following the rotating of the container in the reverse rotation direction, wherein the forward rotation direction moves the material to an open end of the container;

moving the material from the open end of the container into the dispensing unit;

generating a signal indicating a sufficient amount of material is in the dispensing unit;

determining a time period representing a time it took to move the material from the closed end of the container, until the signal indicating the sufficient amount of material is in the dispensing unit; and estimating the amount of the material in the container, by use of the determined time period.

2. The method according to claim 1 wherein the material is a toner used to generate images by a printing machine.

3. The method according to claim 1 wherein the determined time period is inserted into a transfer function to determine an estimate of the amount of material remaining in the container.

4. The method according to claim 1 wherein the determined time period is compared to other experimentally obtained time periods and their corresponding material amounts.

5. The method according to claim 1 wherein the sensing, rotating, detecting and estimating steps are controlled by a controller.

6. A method for sensing an amount of toner in a container held in a horizontal position within a printing machine and having an internal rib used to move the toner in the container when the container is rotated, the method comprising:

sensing by a level sensor within a dispensing unit of the printing machine, an amount of toner within the dispensing unit which causes the level sensor to issue a signal;

rotating the container holding the toner in a rotation direction reverse to a direction to dispense the toner based on the signal issued by the level sensor for a certain amount of time, wherein the reverse rotation direction moves the toner to a closed end of the container;

rotating the container in a forward rotation direction following the certain time of rotating the container in the reverse rotation direction, wherein the forward rotation direction moves the toner to an open end of the container;

moving the toner from the open end of the container into the dispensing unit while the container is rotating in the forward rotation;

ending the forward rotation of the container when the sensor generates a signal indicating a sufficient amount of toner is in the dispensing unit;

determining a time period representing a time it took to move the toner from the closed end of the container until the level sensor generated the signal indicating the sufficient amount of toner in the dispensing unit; and estimating the amount of toner in the container using the determined time period.

7. The method according to claim 6 wherein the toner is one of a one component toner consisting primarily of toner particles or a two component toner of at least magnetic granules having toner particles adhering triboelectrically thereto.

8. The method according to claim 6 wherein the determined time period is inserted into a transfer function to determine an estimate of the amount of material remaining in the container.

9. The method according to claim 6 wherein the determined time period is compared to other experimentally obtained time periods and their corresponding material amounts.

10. The method according to claim 6 wherein the sensing, rotating, detecting and estimating steps are controlled by a controller.

11. A system for sensing an amount of toner in a container held in a horizontal position within a printing machine and having an internal rib used to move the toner in the container when the container is rotated, the system comprising:

a dispensing unit configured to receive the toner from the container;

a toner level sensor within the dispensing unit to sense a level of the toner which is in the dispensing unit;

a drive mechanism and motor arrangement in operational connection with the container and configured to selectively rotate the container in both a forward and a reverse direction;

a controller configured with an internal timer, an input to receive signals from the level sensor, an output to send control signals to the drive mechanism, and a computation section to store and implement a program to estimate an amount of toner in the container; and a time period determined by the timer, wherein the time period is used by the program to estimate the amount of toner in the container.

12. The system according to claim 11 wherein the motor is a reversible motor.

13. The system according to claim 11 wherein the gearing arrangement is a reversible gearing arrangement.

14. A system for sensing an amount of toner in a container held within a printing machine comprising:

a development system configured to hold the container in a horizontal position within the printing machine, the container having an internal rib used to move the toner in the container when the container is rotated;

a dispensing unit configured to receive the toner from the container;

a toner material level sensor within the dispensing unit to sense a level of the toner which is in the dispensing unit;

a motor and gearing arrangement configured to rotate the container in a forward and a reverse direction;

a controller configured to receive signals from the level sensor, to control operation of the motor, and to implement a level sensing operation, wherein the level sensing operation senses a signal from the level sensor of a low toner condition, instructs the motor to rotate the container in a reverse rotation direction to move the toner within the container to a back end of the container, instructs the motor to return to normal rotation of the container to move the toner to the opening of the container until the level sensor indicates a sufficient level of toner is in the dispensing unit, begin a timer to record an amount of time starting from the return to normal rotation until the level sensor indicates the existence of sufficient toner, and a determination of the amount of toner within the container by use of the recorded time.

15. The system according to claim 14 wherein the recorded time compared to a listing of other recorded times which correlate to an estimate of the amount of toner remaining in the container.

16. The system according to claim 14 wherein the recorded time is inserted into a transfer function to determine an estimate of the amount of toner remaining in the container.

17. The system according to claim 14 wherein the motor is a reversible motor.

18. The system according to claim 14 wherein the gearing arrangement is a reversible gearing arrangement.

* * * * *